US011591846B2

(12) United States Patent
Vianello et al.

(10) Patent No.: US 11,591,846 B2
(45) Date of Patent: Feb. 28, 2023

(54) DOSAGE DEVICE FOR EXTRUDING A BICOMPONENT OR MONOCOMPONENT SEALANT

(71) Applicant: FOREL SPA, Frazione Vallio (IT)

(72) Inventors: Fortunato Vianello, Frazione Vallio (IT); Riccardo Vianello, Frazione Vallio (IT)

(73) Assignee: FOREL SPA, Frazione Vallio (IT)

( * ) Notice: Subject to any disclaimer, the term of this patent is extended or adjusted under 35 U.S.C. 154(b) by 0 days.

(21) Appl. No.: 15/668,440

(22) Filed: Aug. 3, 2017

(65) Prior Publication Data

US 2018/0038153 A1 Feb. 8, 2018

(30) Foreign Application Priority Data

Aug. 4, 2016 (IT) ..... 102016000082108

(51) Int. Cl.
*E06B 3/673* (2006.01)
*B05C 11/10* (2006.01)
(Continued)

(52) U.S. Cl.
CPC ..... *E06B 3/67347* (2013.01); *B05C 11/1036* (2013.01); *E06B 3/66314* (2013.01);
(Continued)

(58) Field of Classification Search
CPC ..... B05C 11/1036; B05C 11/10; B05C 11/101; B05C 11/1013; B05C 11/1047; E06B 3/67347
See application file for complete search history.

(56) References Cited

U.S. PATENT DOCUMENTS 4,234,372 A * 11/1980 Bernhard ..... B29C 47/026 156/356
4,265,270 A * 5/1981 Satoh ..... G05D 16/0661 137/495
(Continued)

FOREIGN PATENT DOCUMENTS

DE 102007051610 A1 4/2009
DE 102009024939 A1 12/2010
(Continued)

*Primary Examiner* — Matthew J Daniels
*Assistant Examiner* — Andrew L Swanson
(74) *Attorney, Agent, or Firm* — Cantor Colburn LLP

(57) ABSTRACT

A dosage device for extruding a bicomponent or a monocomponent sealant, particularly for an automatic machine for sealing a perimetric edge of an insulating glazing unit constituted by at least two glass sheets and by at least one spacer frame, having a finite width, is arranged proximate to the perimeter at a finite distance from the margin of the glass sheets, includes a first dosage assembly and a separate second dosage assembly for the dosage and feeding of the sealant, which can be activated alternately, in a first feeding step and in a third feeding step, so that one of them provides flow continuity to an extrusion nozzle while the other one is in the reloading step. The first and second dosage assemblies are activatable, in a second swapping step that is intermediate with respect to the first and third feeding steps, simultaneously and jointly, one of them having a flow-rate ramp that passes from the steady-state value to zero and the other one complementarily having a flow-rate ramp that passes from zero to the steady-state value.

2 Claims, 14 Drawing Sheets

(51) Int. Cl.
*E06B 3/663* (2006.01)
*B05C 5/02* (2006.01)
*E06B 3/67* (2006.01)

(52) U.S. Cl.
CPC ..... *E06B 3/66352* (2013.01); *E06B 3/6733* (2013.01); *B05C 5/0204* (2013.01); *E06B 3/6715* (2013.01)

(56) References Cited

U.S. PATENT DOCUMENTS 4,629,410 A 12/1986 Hehl
5,054,650 A * 10/1991 Price ..... B05B 13/0431 118/688
5,961,759 A 10/1999 Schubert
6,514,569 B1 * 2/2003 Crouch ..... B05C 5/0208 222/134
6,692,572 B1 * 2/2004 Allen ..... B05C 11/10 118/694
6,726,773 B1 * 4/2004 Yanagita ..... B05B 9/047 118/323
8,480,940 B2 7/2013 Schuler
9,079,335 B2 7/2015 Schuler
2012/0180936 A1 7/2012 Schuler
2015/0028055 A1 * 1/2015 Hayama ..... B05C 5/025 222/55
2015/0075635 A1 * 3/2015 Vega ..... B05C 11/1013 137/14

FOREIGN PATENT DOCUMENTS

DE 102009035002 A1 1/2011
EP 0823318 B1 3/2000
EP 0823531 B1 10/2001
EP 2735418 A1 5/2014
FR 2609093 A2 7/1988
WO 8806925 A1 9/1988
WO 2009053090 A2 4/2009
WO 2010142428 A1 6/2010
WO WO-2012046113 A1 * 4/2012 ..... E06B 3/67343
WO 2015113080 A1 8/2015

* cited by examiner

DOSAGE DEVICE FOR EXTRUDING A BICOMPONENT OR MONOCOMPONENT SEALANT

CROSS REFERENCE TO RELATED APPLICATIONS

This application is related to and claims the benefit of Italian Patent Application No. 102016000082108, filed on Aug. 4, 2016, the contents of which are herein incorporated by reference in their entirety.

TECHNICAL FIELD

The present invention relates to a dosage device for extruding a bicomponent or monocomponent sealant, particularly for an automatic machine for sealing a perimetric edge of an insulating glazing unit.

BACKGROUND

Currently it is known to deposit the rigid spacer frame (3) or the flexible spacer profile (5) pre-spread with sealant (6) and/or adhesive (6') on a glass sheet (2) so that the assembly is then mated with a second glass sheet (2') and sealed over the entire external peripheral region so as to constitute the so-called insulating glazing unit (1).

The operation can further be multiple so as to obtain the insulating glazing unit 1 constituted by three glass sheets (2, 2', 2") and two frames (3, 3') or spacer profiles (5, 5'), as well as "n" glass sheets (2, 2', 2", 2'", 2M, 2'*m*, 2"*m*) and "n−1" frames (3, 3', 3") or spacer profiles (5, 5', 5").

And it is when the cavity delimited by the glass sheets and by the spacer frame has considerable dimensions, in combination with a considerable extension of the external peripheral region, but not only for these situations, that the invention according to the present application is of essential importance.

Taking for granted that the subsequent use of the insulating glazing unit (1), i.e., in the door or window, is known, in detail the insulating glazing unit (1) is constituted by the composition of two or more glass sheets (2, 2', 2", 2'", 2M, 2'*m*, 2"*m*), which are separated by one or more spacer frames (3, 3', 3"), generally made of inorganic material, such as for example aluminum or stainless steel or mixed inorganic/organic material, the second one being generally for example made of polyvinyl chloride (PVC), generally hollow and microperforated on the face that is directed inward, the spacer frames (3, 3', 3") containing hygroscopic material (4) in their hollow part and being provided with a butyl sealant (6) (constituting the so-called first seal) on the lateral faces and the chamber (or chambers), delimited by the glass sheets (2, 2', 2", 2'", 2M, 2'*m*, 2"*m*) and by the spacer frame or frames (3, 3', 3"), being able to contain for example air or gas (8) or gas mixtures (8) which provide the insulating glazing unit (1) with particular properties, for example thermal insulation and/or soundproofing properties.

The use has also recently become widespread of a spacer profile (5) having an essentially rectangular cross-section, which optionally contains two receptacles on its two sides intended for the butyl sealant (6), made of synthetic organic material, such as for example silicone and EPDM rubbers (from the English Ethylene-Propylene Diene Monomer), which is expanded, containing hygroscopic material (4) and is provided in its sides or part thereof with an adhesive (6') which is useful for mechanical bonding with the glass sheets.

Joining between the glass sheets (2, 2', 2", 2'", 2M, 2'*m*, 2"*m*) and the spacer frame or frames (3, 3', 3") or (5, 5', 5") is obtained by means of two sealing levels; the first one (also known in the jargon as primary) (6) having the function of providing a hermetic seal and the initial bonding between said components and affecting the lateral surfaces of the frame and the portions of the adjacent glass sheets, already mentioned earlier (butyl sealant, thermoplastic); the second one (also known in the jargon as secondary) (7), typically constituted by an elastomeric bicomponent sealant, such as polysulfide (PS) or polyurethane (PU) or silicone (SI), processed at room temperature, but also constituted by monocomponent sealant of the type processed at room temperature or of the hot processed type, having the function of providing final cohesion among the components and mechanical strength of the joint between them and affecting the compartment constituted by the outer surface of the spacer frame (3, 5) and by the internal faces of the glass sheets up to the edge thereof (see FIG. 1A to FIG. 1F).

In the case of a spacer profile (5) made of expanded synthetic material, the first sealing level is replaced (in this case losing the hermetic sealing function) or can be integrated (in this case preserving the hermetic sealing function) by an adhesive (6'), for example an acrylic adhesive, which is already spread on the lateral faces of said spacer profile and is covered by a removable protective film (see FIG. 1D, in which said film has already been removed).

The glass sheets (2, 2', 2", 2'", 2M, 2'*m*, 2"*m*) used in the composition of the insulating glazing unit (1) can have different shapes as a function of the use thereof; for example, the outer glass sheet (outer being understood with respect to the building) can be normal or reflective or selective (in order to limit the thermal input during summer months) or laminated/armored (for intrusion prevention/vandalism prevention/bulletproof functions) or laminated/tempered (for safety functions) or combined (for example reflective and laminated, in order to obtain a combination of properties), the inner glass sheet (inner being understood with respect to the building) can be normal or low-emissive (in order to limit heat loss during the winter months) or laminated/tempered (for security functions) or combined (for example low-emissive and laminated in order to obtain a combination of properties).

The simple summary given already makes it clear that a manufacturing line for obtaining the insulating glazing unit product (1) requires many processes in a cascade arrangement and in particular comprises the process of second sealing to which the present application relates.

The processes for the production of the insulating glazing unit (1), each requiring a corresponding and particular machine to be arranged in series with respect to the other complementary ones, are, by way of non-limiting example and at the same time not all necessary, the following:

EDGING on the peripheral face of the glass sheet in order to remove any coatings in order to allow and maintain over time the bonding of the primary sealant (6) and the secondary sealant (7);

BEVELING of the sharp edges of the glass sheet, both to eliminate the marginal defects introduced with the cutting operation, which potentially could trigger cracks, and to reduce the risks of injury in subsequent handling of the glass sheets (2, 2', 2", 2'", 2M, 2'*m*, 2"*m*) and of the finished insulating glazing unit (1);

WASHING of the individual glass sheets, with alternation between the inner glass sheet, any intermediate glass sheets, and the outer glass sheet (the orientation being the one defined earlier);

APPLICATION OF THE SPACER PROFILE: the spacer profile (3, 3', 3") manufactured previously, filled with hygroscopic material (4) and covered on its lateral faces with a thermoplastic (butyl) sealant (6), having functions of providing a seal against the entry of humidity and the leakage of the gas (8), in machines which are external with respect to the line for the production of the insulating glazing unit (1), is applied to one of the glass sheets that constitute the insulating glazing unit (1) in an adapted station of the line for producing the insulating glazing unit (1); as an alternative, a continuous strip of spacer profile (5, 5', 5") is unwound from a spool and is applied to one of the glass sheets until it also forms a closed frame, which is manufactured directly in adhesion against one of the glass sheets after removal of the protective film, on the same line for the production of the insulating glazing unit (1);

COUPLING AND PRESSING of the assembly constituted by the glass sheets and the frame or frames (i);

FILLING WITH GAS of the chamber or chambers thus obtained, for example performed in the same machine that performs the functions of the preceding paragraph, or in a subsequent machine, as shown in the figures, which show the complete configuration of the line for producing the insulating glazing unit (1);

SECOND SEALING of the assembly of the components: glass sheets (2, 2', 2", 2''', 2M, 2'*m*, 2"*m*), spacer frame (3, 3', 3", 5, 5', 5"), at the perimeter.

The invention that is the subject matter of the present application relates in particular to the manner of feeding the sealant (which is bicomponent but also optionally monocomponent) to the extrusion head and nozzle, a manner, that is adapted to provide high flow-rates of the sealant and to eliminate any discontinuity, so as to obtain a high productivity of the line for producing the insulating glazing unit (1) and a high functional and aesthetic quality of the filling of the perimetric joint.

The processes listed above can be performed by the respective machine automatically or semiautomatically or, for some operations, with a manual method.

Machines and methods are known for performing the second sealing in order to provide many inventions, which relate to the solutions for the dosage and feeding of the secondary sealant (7) to the head and therefore to the extrusion nozzle, which we define as of the first type or with flow discontinuity, since the dosage devices of the bicomponent products or the dosage device of the monocomponent product, once the contained product has been depleted, must be reloaded, and this occurs by actuating reloading and discharge valves, entailing that during the reloading step the flow toward the extrusion nozzle is interrupted; in this case, the sealing product is distributed proximate to the rigid spacer profile (3, 3', 3") or to the flexible spacer profile (5, 5', 5") in order to join it mechanically to the glass sheets (2, 2', 2", 2''', 2M, 2'*m*, 2"*m*) and until alignment occurs with the edges of the glass sheets or with the edge of the smallest glass sheet (2'*m*, 2"*m*) (in the case of insulating glazing units with offset glass sheets (2M, 2'*m*, 2"*m*), as shown in FIGS. 1C, 1E, 1F) and constitute a sealing barrier against humidity, which must not enter the insulating glazing unit (1), and the filler gas (8), which must not escape toward the outside of the insulating glazing unit 1.

These inventions of the first type, being widespread and therefore common and known since 1980, are neither listed nor commented.

In particular, if the cavity delimited by the glass sheets and by the spacer frame has considerable dimensions (product, understood as multiplication, of the width of the spacer frame by the depth at which it is placed with respect to the edges of the glass sheets, a product which defines an area) and if the extensions of the outer peripheral region are also extended (constituting a length), so that the need for a high and uninterrupted flow-rate (determined by the product, understood as multiplication, of said area by the relative speed between the extrusion nozzle and the peripheral region of the insulating glazing panel) of sealing product must be solved with innovative solutions, the following prior art documents have been made evident and we define them as of the second type or with flow continuity (since flow toward the extrusion nozzle is not interrupted):

U.S. Pat. No. 9,079,335 B2 with German priority DE 10 2009 024 939 dated 9 Jun. 2009 and international equivalent WO 2010/142428 (A1)—proprietor Bystronic Lenhardt GmbH.

U.S. Pat. No. 8,480,940 B2 with German priority DE 10 2007 051 610.1 dated 24 Oct. 2007 and international equivalent WO 2009/053090 A2—proprietor Bystronic Lenhardt GmbH.

The difference between inventions of the first type and inventions of the second type is the flow-rate of the sealing fluid, which is modest and discontinuous in the first case and important and continuous in the second case and is such as to require an additional inventive step with respect to the background art of the first type.

This inventive step can be found in the invention according to the present application, not only with respect to inventions of the first type but also and in particular with respect to the two titles listed above of the second type (which use pumps that entail the problems that will be described), which are commented hereinafter.

U.S. Pat. No. 9,079,335 B2 highlights the need to extrude more viscous sealants, such as silicone, and with high flow-rates, as required in insulating glazing panels that have considerable distances between the glass sheets, as well as the need to follow the productivity increase of modern insulating glazing unit production lines (column 4 lines 21-26, which state verbatim: "According to the invention, however, it is possible to process the silicone with flow capacities, which are as large as required for insulating glass panes comprising a large distance between the glass panels, so as to be able to fully utilize the short clock cycle of modern insulating glass production lines").

This is achieved by using gear pumps (15, 16, the reference numerals are the ones of the patent), the first one controlling the flow of the base material, the second one controlling the flow of the catalyst material, instead of the usual piston pumps, and by resorting to a dynamic mixer instead of the usual static mixer.

This solves the following problem of the background art of the first type (verbatim quote from column 1, lines 43-45): "the sealing process of the insulating glass pane must be interrupted to refill the main component and the additional component into the respective piston-cylinder unit. During this time, a sealing of insulating glass panes is not possible.".

U.S. Pat. No. 8,480,940 B2, in addition to referencing the same background art and the same problem, recycles the characteristic according to the preceding invention, since (column 3 lines 47-53) it states again (verbatim): "With a sealing device according to the invention, it is possible to process the silicone with throughputs, which are as large as necessary for insulated glass panes comprising a large distance between the glass plates, so as to be able to fully utilize the short clock times of modern insulated glass production lines.".

This background art of the second type has the following drawbacks:

U.S. Pat. No. 9,079,335 B2 resorts to dosage gear pumps, both for the base product, with the pump 15, and for the catalyst product, with the pump 16 (the reference numerals are the ones of the patent), and this allows continuity and control of flow-rates, the gear pumps being fed respectively by double-acting piston transfer pumps 6, 6' which are not dosage pumps but are solely pumps for drawing and transferring from the storage drums 3, 4, together with dosage precision, which typically is in the 10:1 volumetric proportion (which is why the gear pumps and the transfer pumps are shown with different dimensions in the figures).

And this solves, in principle, the described problems of the background art of the first type of interruption of the sealing during the step for reloading the dosage devices and of flow-rate limiting. However, gear pumps, when used to pump products which are viscous and unfortunately non-Newtonian and sometimes corrosive, such as sealants used in the production of insulating glazing units and when intended for high flow-rates, must be manufactured with very particular refinements which often do not provide a solution regarding the choice of materials and of machining tolerances, and this makes them very expensive. Further, due to abrasion and corrosion, they have a rather short life and a progressive decay of precision during operation, since bypass paths form between the chamber located downstream of the gears and the chamber located upstream as the plays increase and as channels form.

U.S. Pat. No. 8,480,940 B2 resorts to double-syringe dosage pumps 15, 16, 15', 16' of FIG. 1 or to double-acting piston dosage pumps 28, 28' of FIG. 2 (the reference numerals are the ones of the patent), which in turn are fed respectively by double-acting piston pumps 11, 11', which are not dosage pumps but solely for drawing and transferring from the storage drums, and this in principle solves the described problems of the background art of the first type of interruption of sealing during the reloading step of the dosage device and of flow-rate limiting.

However, these dosage pump solutions, by resorting to stroke limit exchange valves 13, 14, 13', 14' (the reference numerals are the ones of the patent), have the great problem of sudden transient conditions during the opening and closing of said exchange valves, and this causes pressure peaks, imbalances in the base product/catalyst product dosage ratio, discontinuities in the aesthetics and geometry of the seal of the joint.

Uses of a single system for dosage and pumping of a sealant, or uses of two distinct systems which coexist but are each intended to use a distinct sealant and only for the need to operate alternately in the same sealing machine with more than one type of sealant (typically PS and SI or PS and PU) ale also known.

The aim of the present invention is therefore to eliminate the drawbacks of the background art, by providing a device that allows continuity of the sealing process.

SUMMARY

Within this aim, the present invention allows to achieve high flow-rates of the sealing fluid and also a lack of discontinuity of extrusion even in the situation of large dimensions (distance between the glass sheets and depth of the sealant) of the joint and of considerable extension of the perimeter.

The invention also provides a device that allows to achieve dosage precision and to maintain dosage precision over time, eliminating the problems of the background art of the second type.

The invention further reduces load losses of the fluid in its path from the dosage devices to the extrusion nozzle.

This aim, these advantages and others which will become better apparent hereinafter are achieved by providing a dosage device (999) for extruding a bicomponent or monocomponent sealant, particularly for an automatic machine (1000) for sealing a perimetric edge of an insulating glazing unit (1) constituted by at least two glass sheets (2, 2', 2", 2'", 2M, 2'*m*, 2"*m*) and by at least one spacer frame (3, 3', 3, 5, 5', 5"), having a finite width (w), which is arranged proximate to the perimeter at a finite distance (d) from the margin of the glass sheets (2, 2', 2", 2'", 2M, 2'*m*, 2"*m*), characterized in that it is constituted by a first dosage assembly (400) and by a separate second dosage assembly (500) for the dosage and feeding of said sealant, which can be activated alternately, in a first feeding step and in a third feeding step, so that one of them provides flow continuity to an extrusion nozzle (301) while the other one is in the reloading step, said first and second dosage assemblies (400, 500) being activatable, in a second swapping step that is intermediate with respect to said first and third feeding steps, simultaneously and jointly, one of them having a flow-rate ramp that passes from the steady-state value to zero and the other one complementarily having a flow-rate ramp that passes from zero to the steady-state value.

DESCRIPTION OF THE FIGURES

FIGS. 1A, 1B, 1C and 1E show the rigid frame (3) made of metal profile (typically aluminum or stainless steel or a combination of stainless steel and plastic), which is hollow and is filled with hygroscopic material (4), while FIGS. 1D and 1F show the frame of the flexible type (5), which embeds the hygroscopic material (4) in its mass, but for the purposes of the description the solution indicated for the frame is irrelevant.

Figures 1A, 1B, 1C, 1D, 1E, 1F:
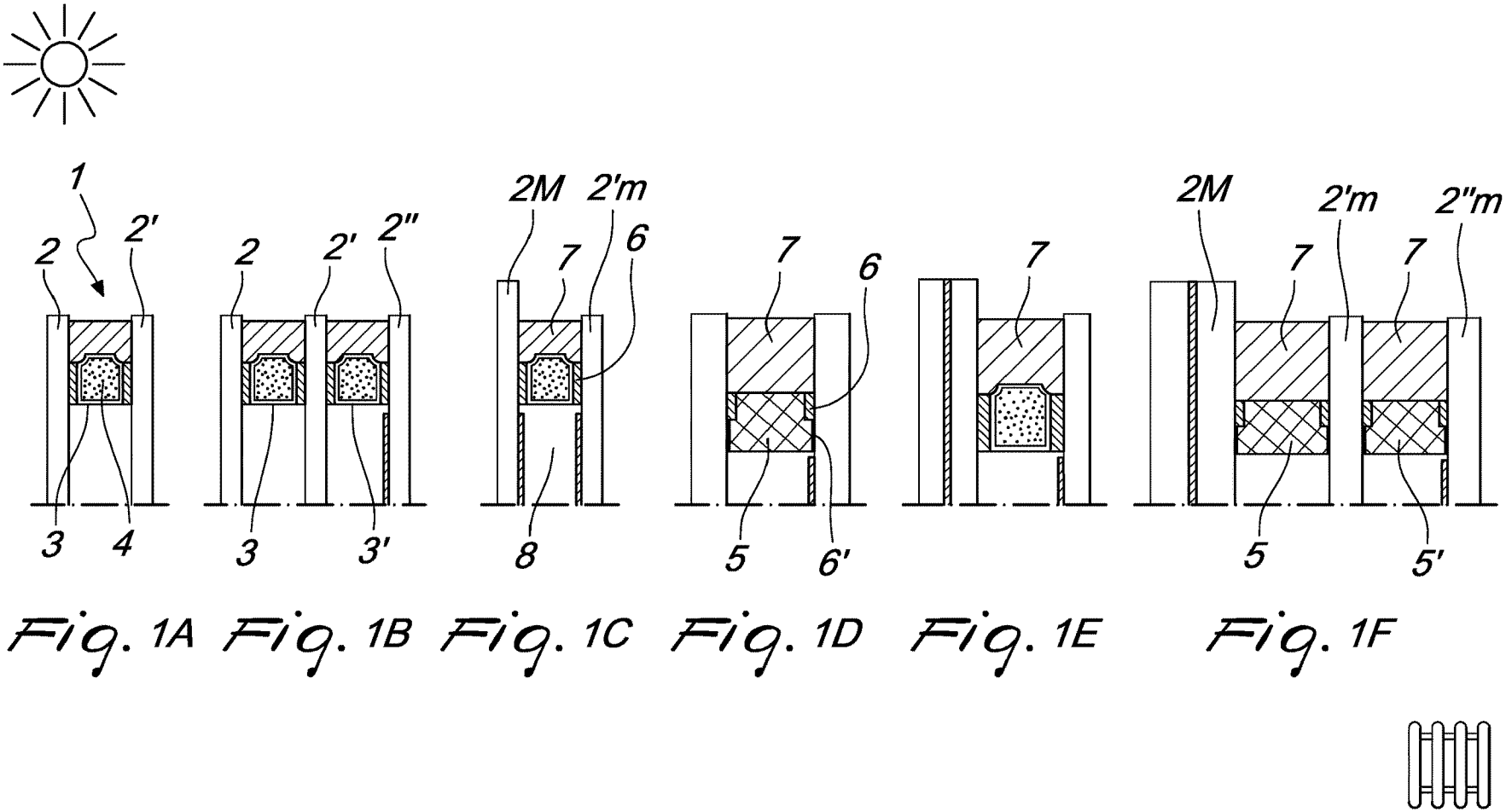
FIGS. 1A to 1F are schematic views of the peripheral portion of the insulating glazing unit 1 in a non-exhaustive exemplifying series of possible combinations: 1A normal; 1B triple glazing with inner sheet with low-emissivity coating; 1C outer sheet with selective coating and offset with respect to the inner sheet with low-emissivity coating; 1D tempered outer sheet and inner sheet with low-emissivity coating; 1E laminated outer sheet offset with respect to the inner sheet with low-emissivity coating; 1F triple glazing with laminated outer sheet offset with respect to the remaining two glass sheets, the inner one having a low-emissivity coating.

The two types of sealant used are shown in cross-section: in black, the butyl sealant (6), which has the function of an initial bonding between the components and of a hermetic seal (first sealing and primary sealant), in the case of a flexible frame, instead, one uses an acrylic adhesive (6') (which is only indicated but not shown, since it has a thickness of a few μm) or the combination of the acrylic sealant (6') and of the butyl sealant (6) applied between the receptacles of the lateral surfaces of the frame and the glass sheets, as can be seen in FIGS. 1D and 1F; in shading, the polysulfide (PS) or polyurethane (PU) or silicone (SI) sealant (7), which has the function of mechanical coupling to the edge and of hermetic seal (second sealing and secondary sealant) applied between the outer surface of the frame and the faces of the glass sheets up to the edge of the glass sheets or of the glass sheet (2'*m*) having the smallest dimensions (in the case of offset glass sheets).

The secondary sealant also contributes, albeit less than the primary sealant, to the hermetic seal against the entry of humidity and the escape of the gas (8).

FIGS. 1D, 1E and 1F show the cases for which the present invention has an essential relevance, i.e., the cases of large dimensions of the glass sheets and of the joint (both in terms of sides of the glass sheets and in terms of thickness and position of the spacer frames) for which the execution of the joint entrusted to the secondary sealant requires a high and continuous flow-rate at the dosage, mixing, feeding, extrusion devices.

The inner/outer orientation is identified visually with icons that represent the sun (outer side) and the radiator (inner side).

In all the figures from 1A to 1F, the secondary sealant (7) is referenced since it is the main subject matter of the present invention.

One deduces from these figures that the insulating glazing unit (1) can have multiple shapes and that the machines for applying the second seal must be suitable and versatile, for example to seal an insulating glazing unit (1) composed of two glass sheets, a unit composed of three glass sheets, a unit with offset glass sheets, a unit composed of three or more glass sheets one or more of which is larger and therefore offset with respect to the remaining ones, characteristics of machines that are already established in the background art, and these machines must be productive in terms of flow-rate and continuity of filling (to which the present patent application relates) of the peripheral joint with the secondary sealant (7), even when said joint has considerable dimensions in the distance between the two glass sheets and in the distance between the outer surface of the spacer frame and the margin of the glass sheet or sheets having smaller dimensions.

Figure 2:
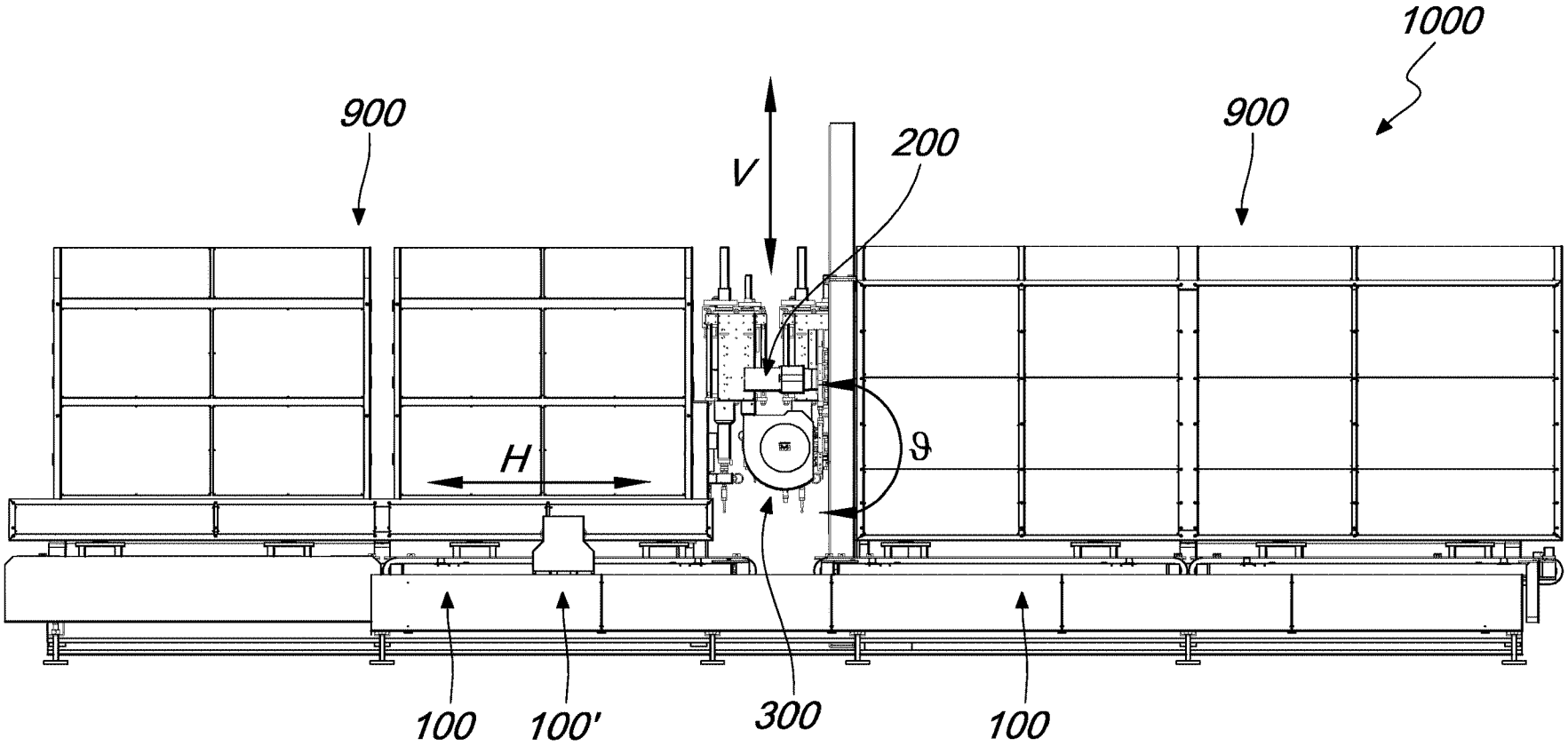
Figure 3:
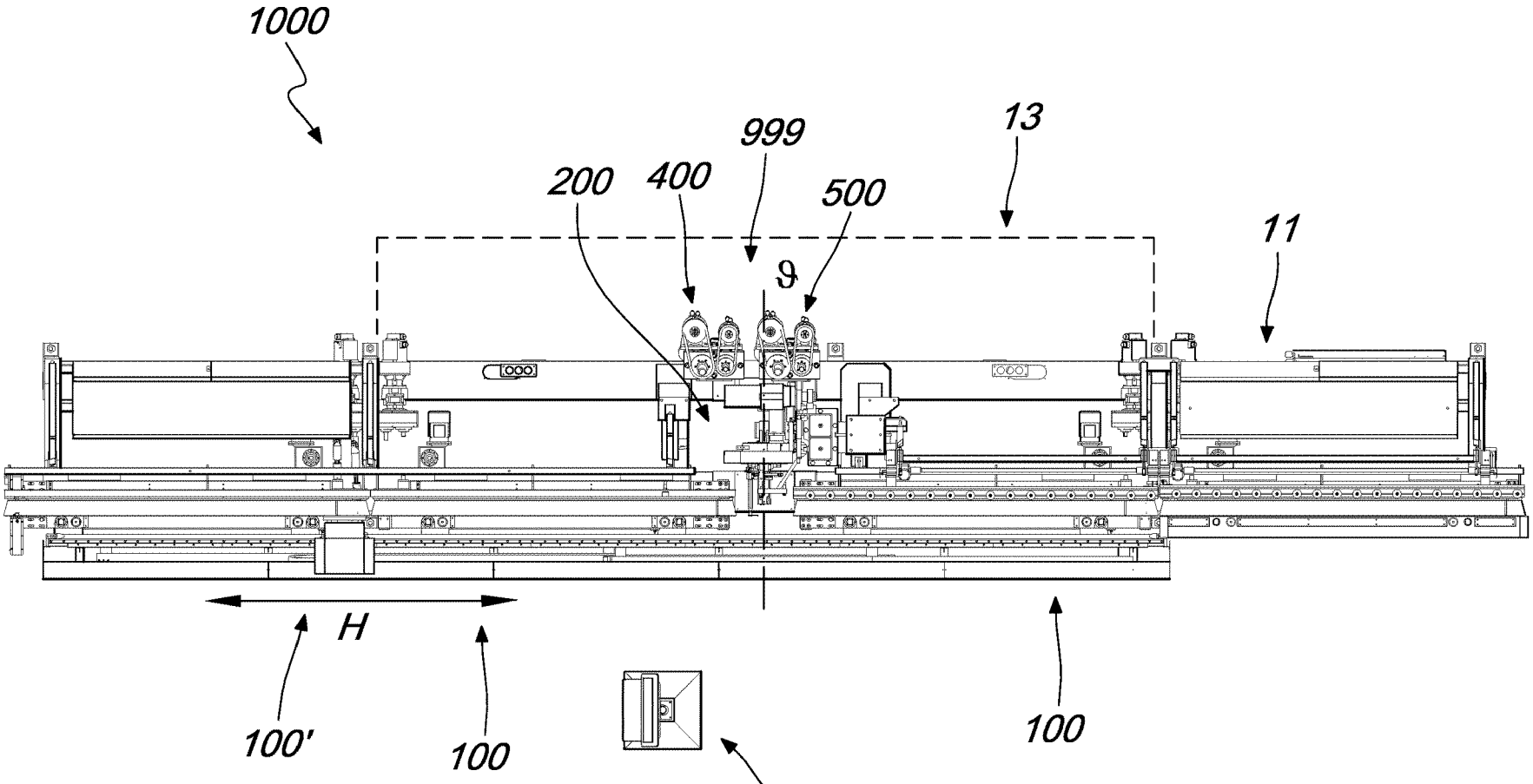
Figure 4:
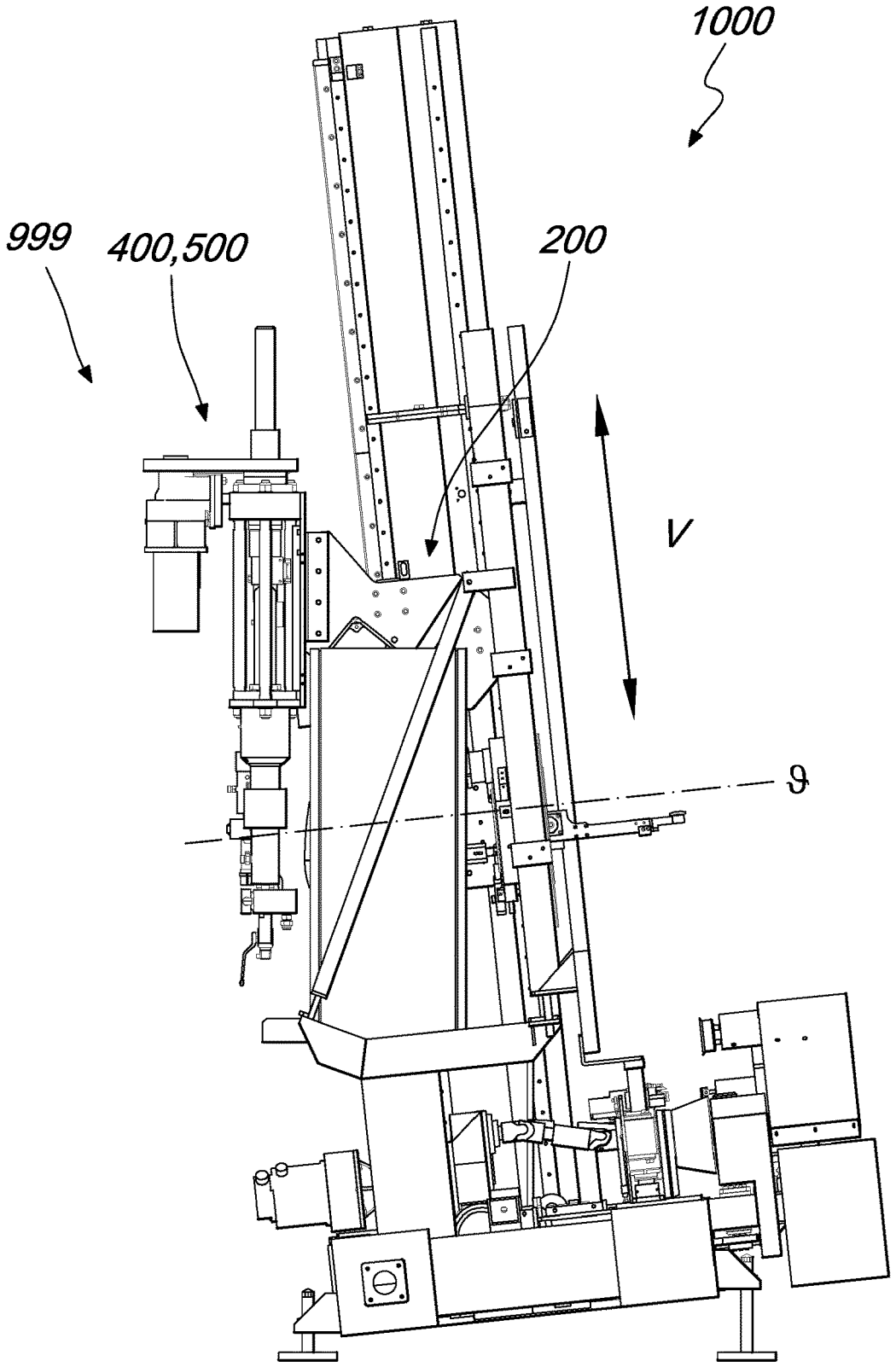

FIGS. 2, 3, 4 show the automatic sealing machine (1000), which includes the subject matter of the present invention, respectively in its overall main views: front, from above, from the side, with identification of the horizontal axis H [provided by the means assembly 100 of the known type constituted both by the motorized pseudo-horizontal conveyors that act on the lower edge 1*d* of the insulating glazing unit (1) and by the carriage with sucker (suckers) (100'), which acts on the face of the insulating glazing unit (1), while the insulating glazing unit (1) remains rested on said motorized pseudo-horizontal conveyors, which are slightly inclined with respect to the horizontal plane, and on a pseudo-vertical sliding surface (900), which is slightly inclined with respect to the vertical plane, provided with free wheels or with an air cushion], of the vertical axis V [assembly (200) of the known type] and of the rotation axis θ [assembly (300) of the known type].

FIGS. 5A, 5B, 6A and 6B are opposite axonometric views (for the visibility of all the components) respectively of the first and second dosage assemblies (400, 500), which can be termed "relay", this term describing their mode of operation, i.e., swapping of the active dosage step between one of the first dosage assembly (400), with dosage devices "A", "a"', and the separate second dosage assembly (500), with dosage devices "B", "b", without discontinuity of the output flow toward the nozzle and then from the nozzle toward the perimetric cavity of the insulating glazing unit to be sealed.

The first and second dosage assemblies (400, 500) constitute the dosage device (999), to which the present application relates.

Figure 7:
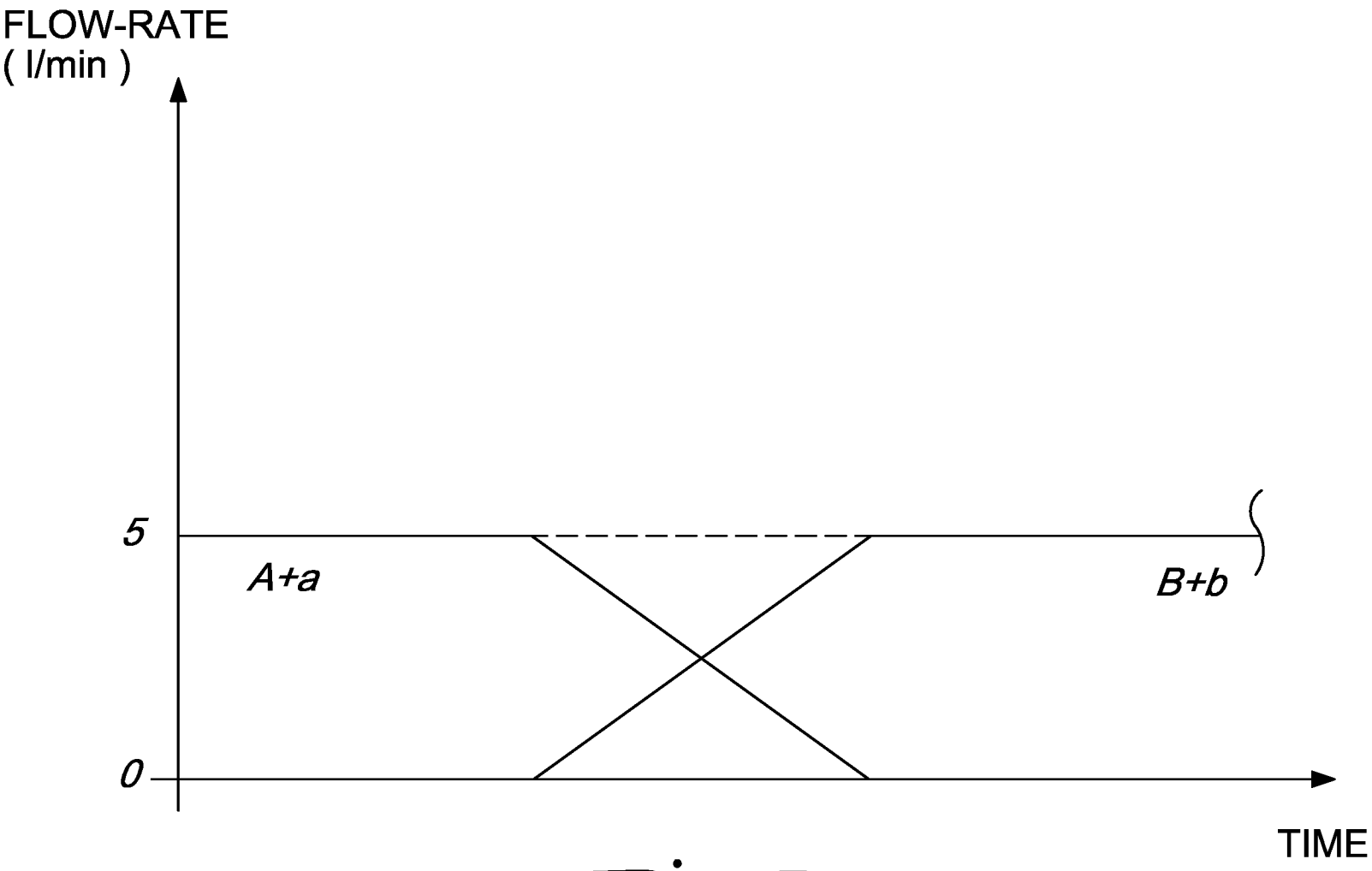

FIG. 7 is the flow-rate chart of each one of the "relay" dosage assemblies in combination with the complementary chart of the other dosage assembly. The ordinates plot the cumulative flow-rate "A+a" [base product "A" "+" catalyst product "a" of the first dosage assembly (400)] and the cumulative flow-rate "B+b" [base product "B" "+" catalyst product "b" of the second dosage assembly (500)]. The abscissas plot time. These charts demonstrate mathematically, as well as intuitively, that in the transition band [swapping between dosage devices of the first dosage assembly (400) and of the separate second dosage assembly (500)] the flow-rate at the extrusion nozzle is unchanged (dashed line).

Figure 8:
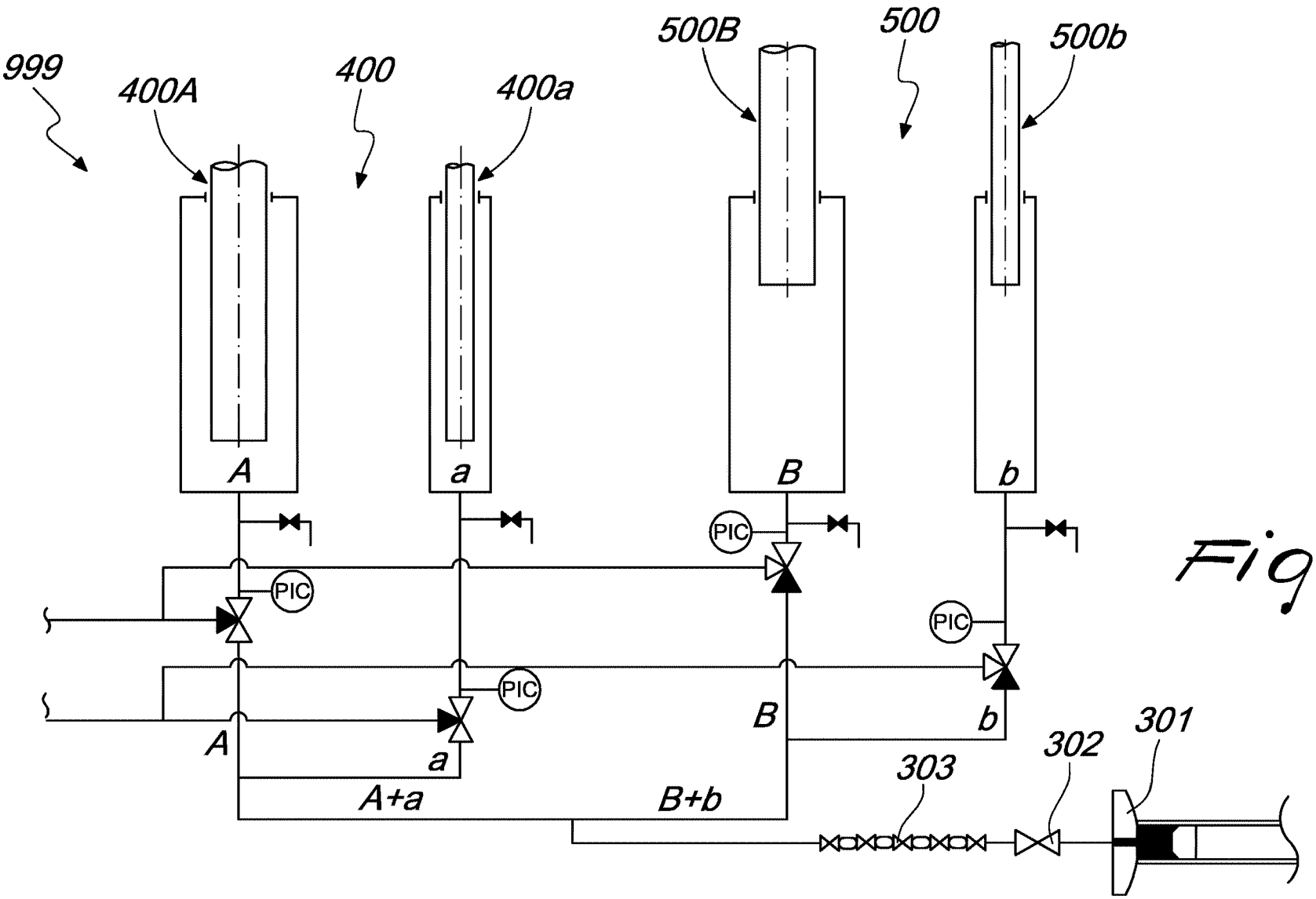

FIG. 8 is the single-line diagram of the circuits of the fluids for the base product "A, B" and catalyst product "a, b" in the interconnection with the first dosage assemblies (400) in the active step and the second dosage assemblies (500) in the reloading step, in the solution using three-way valves for the main circuits.

Figure 9:
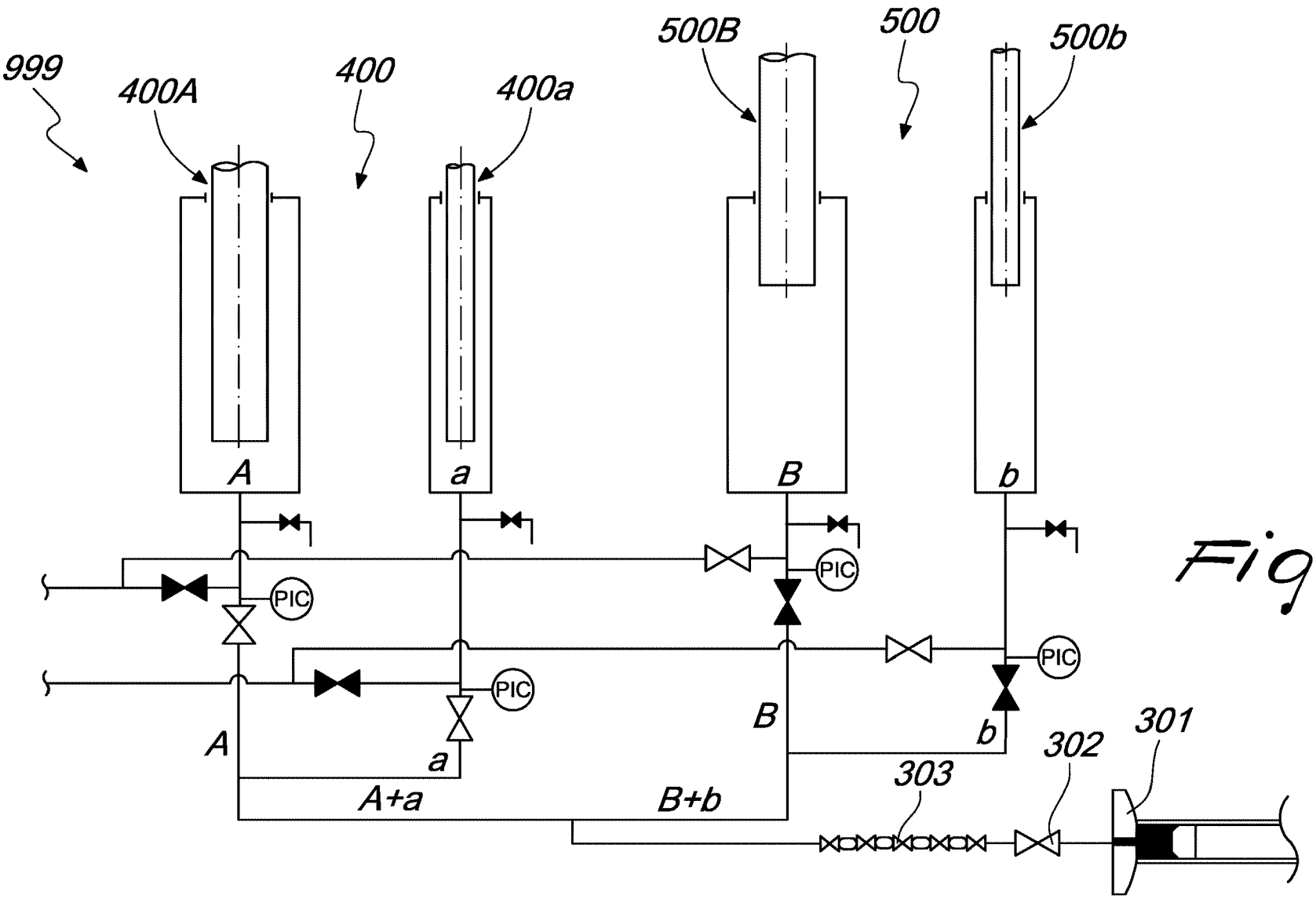

FIG. 9 is the alternative single-line diagram of the circuits of the fluids for the base product "A, B" and catalyst product "a, b" in the interconnection with the first dosage assemblies (400) in the active step and the second dosage assemblies (500) in the reloading step, in the solution using two-way valves, a condition which is more practical and reliable from the systems standpoint.

Figure 10:
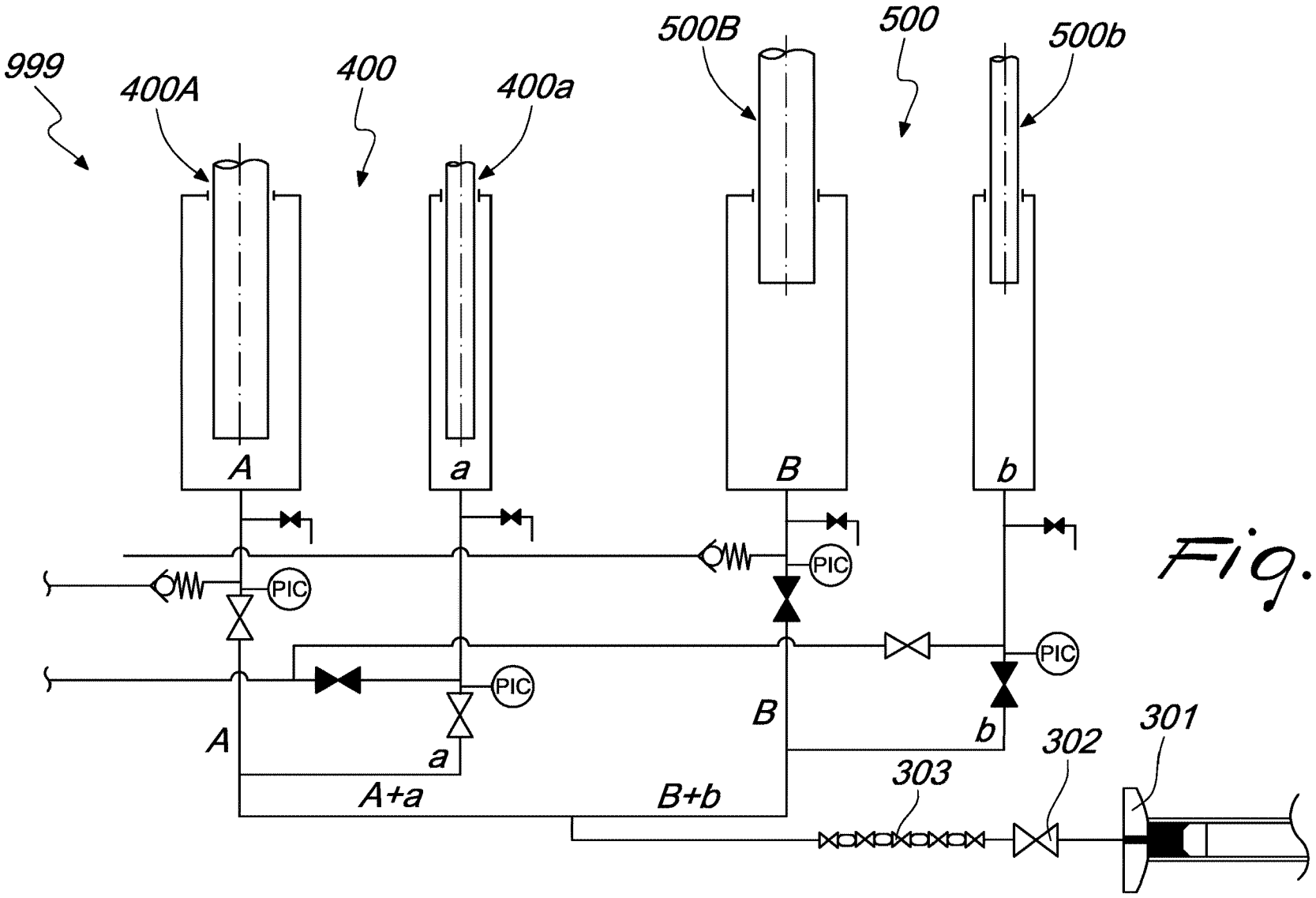

FIG. 10 is an alternative single-line diagram of the circuits of the fluids for the base product "A, B" and catalyst product "a, b" in the interconnection with the first dosage assemblies (400) in the active step and the second dosage assemblies (500) in the reloading step, in the solution using two-way valves and one-way valves, a condition which is more practical and reliable from the systems standpoint.

Figure 11:
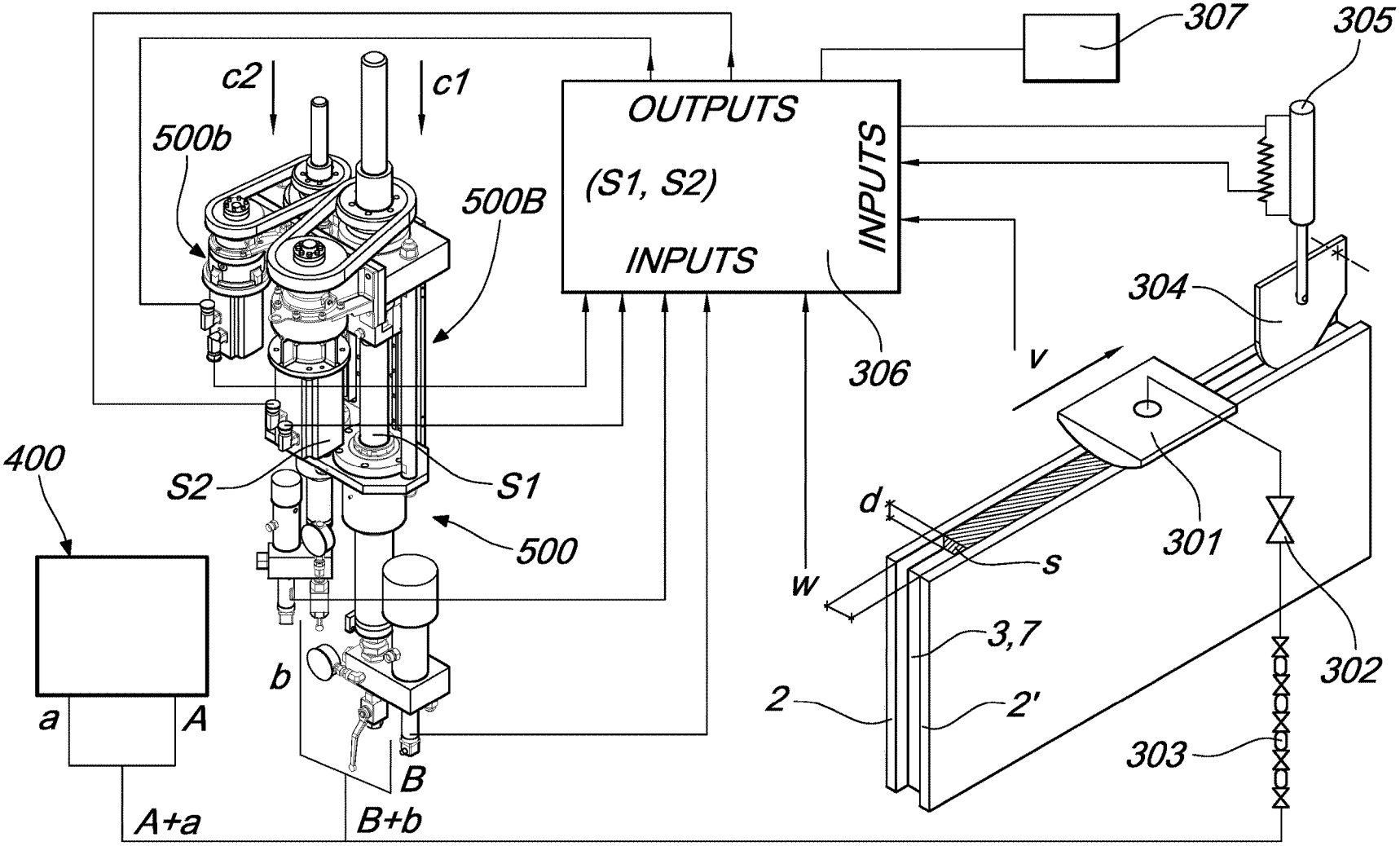
Figure 12A:
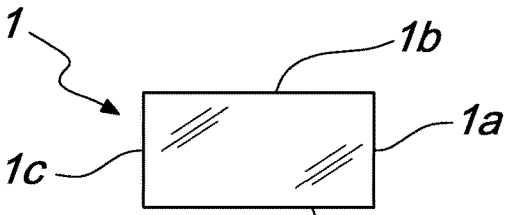
Figure 12B:
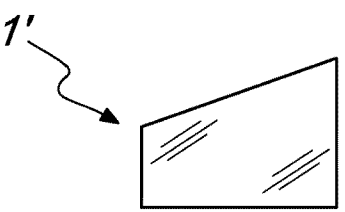
Figure 12C:
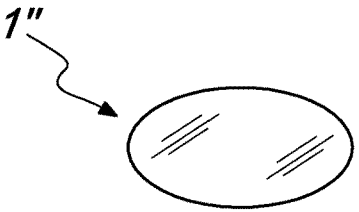
Figure 12D:
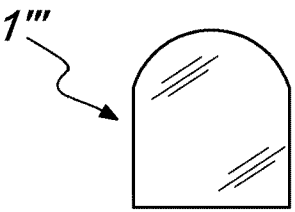

FIG. 11 is a view of the logic and power controllers and circuits.

FIGS. 12A, 12B, 12C and 12D are views respectively of the insulating glazing unit (1) in its following shapes: rectangular (1), polygonal (1'), curvilinear (1"), mixed (1'").

In the case of the rectangular shape (1), the sides are designated in the sequence of the sealing operation, which therefore occurs according to the following progression: side (1*a*), corner (1*a*/1*b*), side (1*b*), corner (1*b*/1*c*), side (1*c*), corner (1*c*/1*d*), side (1*d*), corner (1*d*/1*a*).

Figure 13:
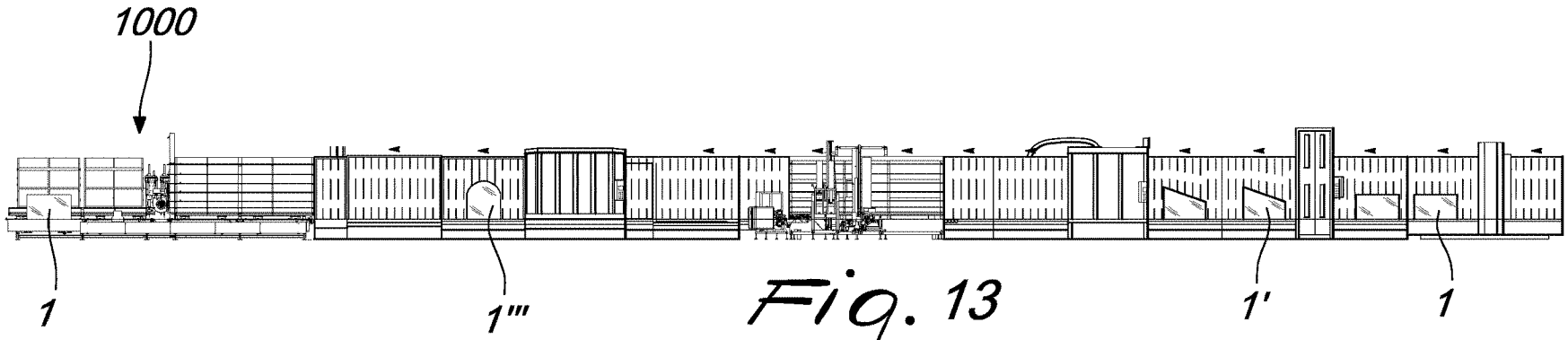

FIG. 13 is a view of an example of insertion of the automatic sealing machine (1000) in the line for the production of the insulating glazing unit (1) (overall view) and does not comprise: electrical/electronic panel, control post and protection devices.

Figure 14:
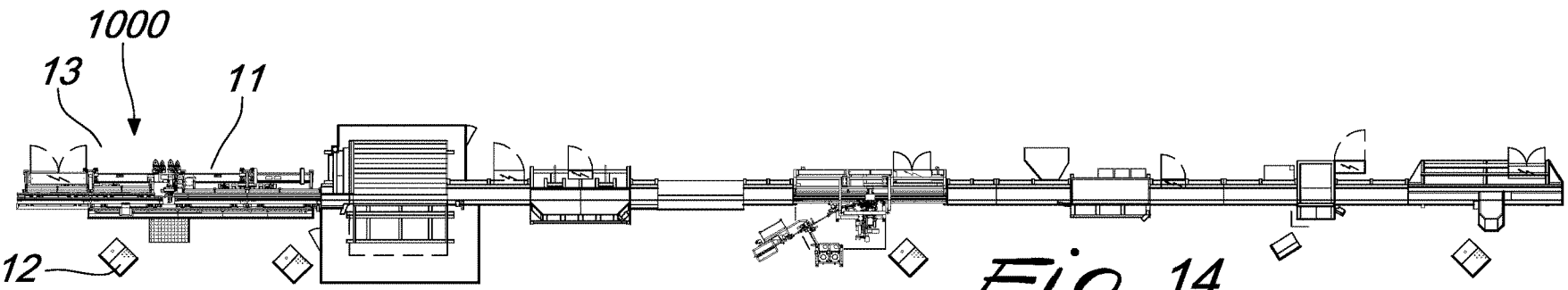

FIG. 14 is a view of an example of insertion of the automatic sealing machine (1000) in the line for the production of the insulating glazing unit (1) (plan view) and includes: electrical/electronic panel (11), control post (12) and protection devices, which are designated generally by (13), be they of the type of mechanical screens, or optical barriers, or laser barriers, or electrically sensitive mats, or region scanners, etc., since particular attention is given not only to the functional, qualitative and productive aspects that are part of the content of the present invention but also to the aspects related to injury prevention.

The following products: insulating glazing unit (1), glass sheet (2, 2', 2", 2'", 2M, 2'*m*, 2"*m*), spacer frame (3, 3', 3", 5, 5', 5") and further components thereof are designated by single-digit numbering.

In particular, in order to distinguish the various possible shapes of the insulating glazing unit (1), as already mentioned, (1) designates the most frequent situation (rectangular), (1') designates the polygonal shape, (1") designates the curvilinear shape, and (1'") designates the mixed shape.

The components that are interfaced with the automatic sealing unit are designated by two-digit numbering.

The main components of the inventive device according to the present application (400, 500) and of the known correlated devices are designated by three-digit numbering, wherein the ones containing two zeros are referred to sets or assemblies while the others are referred to the respective details.

The machines that belong to the line for the production of the insulating glazing unit 1 are designated by four-digit numbering, in the order according to the description, reserving (1000) for the automatic sealing machine.

Figure 15:
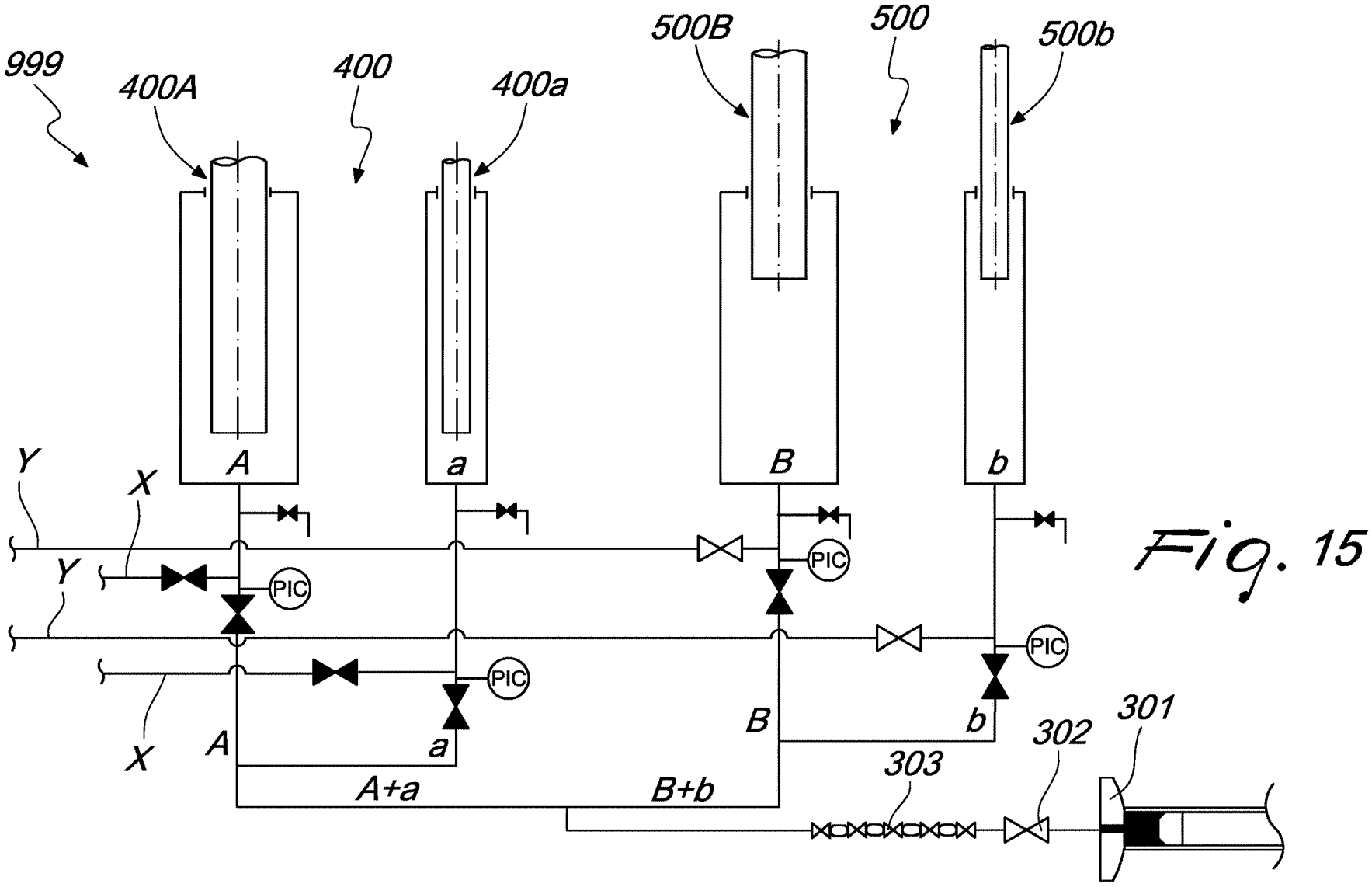

FIG. 15 is a single-line diagram that embodies an alternative use of the dosage assemblies (400, 500), since each assembly dedicated, independently of the other, to the dosage of a sealant, in the illustration the sealant X (composed of a base A and a catalyst a) is used, in order to be able to feed to the perimetric edge of the insulating glazing unit multiple types of sealant.

Figure 16:
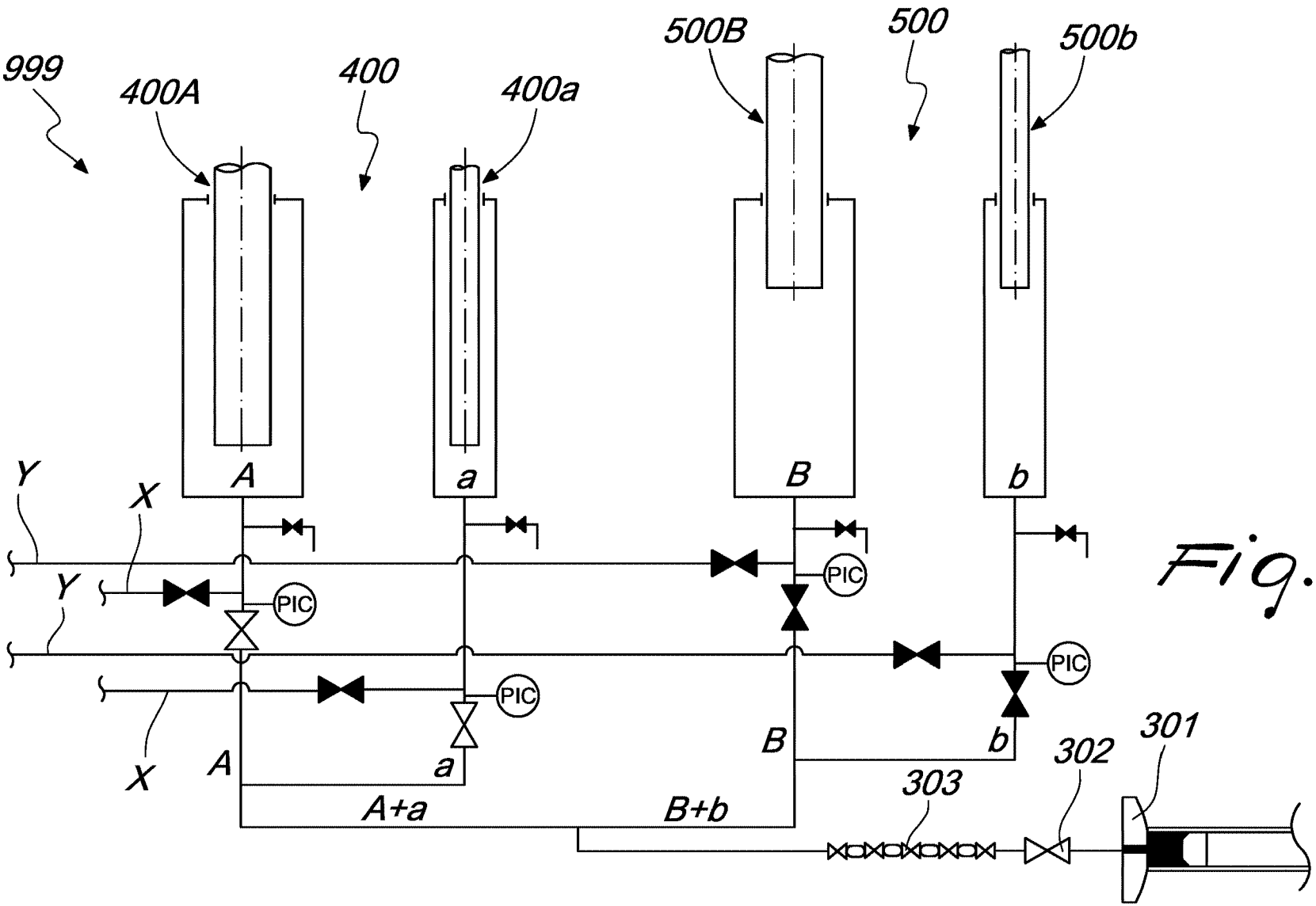

FIG. 16 is a single-line diagram that embodies an alternative use of the dosage assemblies (400, 500), since each assembly dedicated, independently of the other, to the dosage of a sealant, in the illustration the sealant Y (composed of a base B and a catalyst b) is used, in order to be able to feed to the perimetric edge of the insulating glazing unit multiple types of sealant.

DETAILED DESCRIPTION OF THE DRAWINGS

In the exemplary embodiments that follow, individual characteristics, given in relation to specific examples, may actually be interchanged with other different characteristics that exist in other exemplary embodiments.

A detailed description of a way of carrying out the invention will follow.

To describe a way of embodying the invention, which comprises all the equivalents, reference is made to FIGS. 5 to 11 for the general concepts and for the details adapted to make one or more of the possible embodiments of the invention fully understandable to the person skilled in the art.

What is shown partially or not shown in FIGS. 2, 3, 4 regarding the sealing machine per se is instead assumed to be known and therefore not requiring a detailed description (since it is part of the background art), since both the prior art documents of the second type described earlier (which in turn reference the prior art documents of the first type) and the knowledge of the person skilled in the art do not require any clarification for the construction of these parts related to the automatic sealing machine, essentially constituted by the following assemblies: (100) for motion along the synchronous horizontal axis H of the glass sheet by means of its lower edge (1*d*); (100') for motion along the synchronous horizontal axis H of the glass sheet through its front face; (200) for the motion of the sealing head along the synchronous vertical axis V; (300) for the extrusion head that rotates about the polar axis θ; (900) for the pseudo-vertical conveyors for supporting the glass sheet (1).

Each first and second dosage assembly (400, 500) is constituted by the dosage device of said base product [base product which is correlated to the symbol "A" when used in the first dosage assembly (400) and to the symbol "B" when used in the second dosage assembly (500)] and by the dosage device of said catalyst product [catalyst product which is correlated to the symbol "a" when used in the first dosage assembly (400) and to the symbol "b" when used in the second dosage assembly (500)], which, being each in a synchronous electrical tie, can dispense the flow of base product and the flow of the catalyst product in the stoichiometric ratio required by the manufacturer of the secondary sealant [typically 10:1 by volume, but any ratio can be set by means of simple inputs in the control panel (12)].

Although the product is the same, it is identified by different letters ("A" and "B" for the base product and "a" and "b" for the catalyst product) in order to correlate it with the dosage assemblies that alternately process it.

Of course, in the case of a monocomponent sealant the dosage devices are only the main ones (for the base product "A", "B"), since the catalyst product is not present.

Figure 5A:
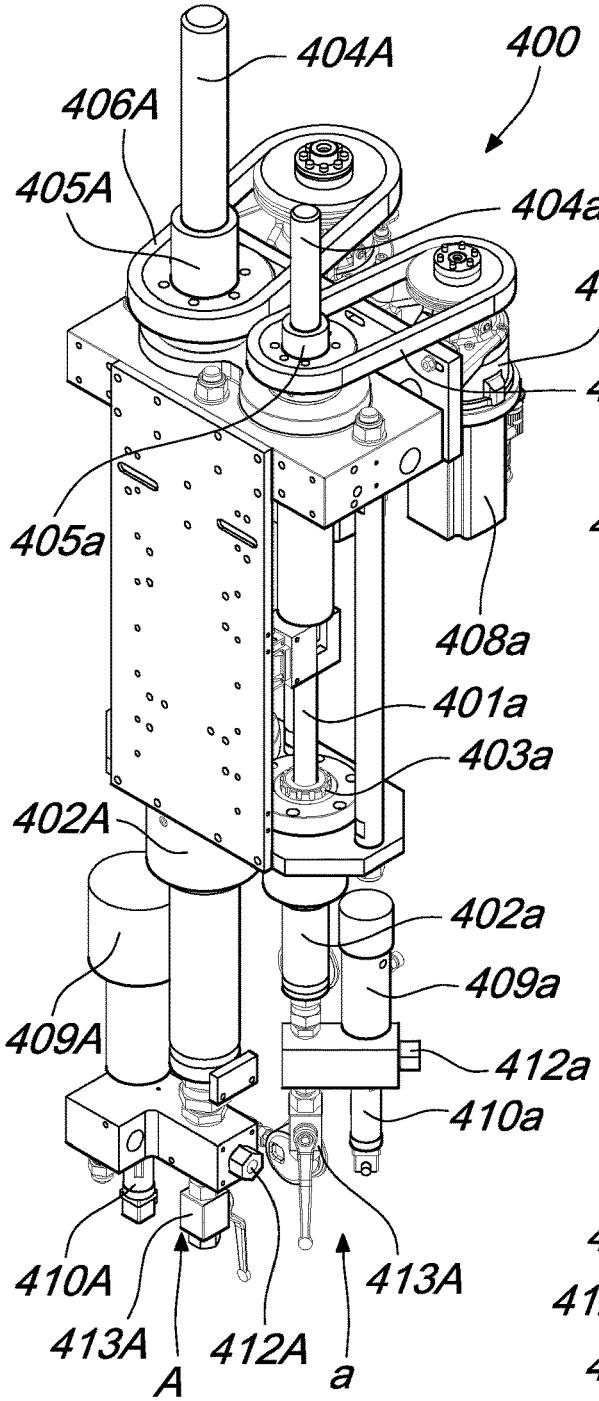
Figure 5B:
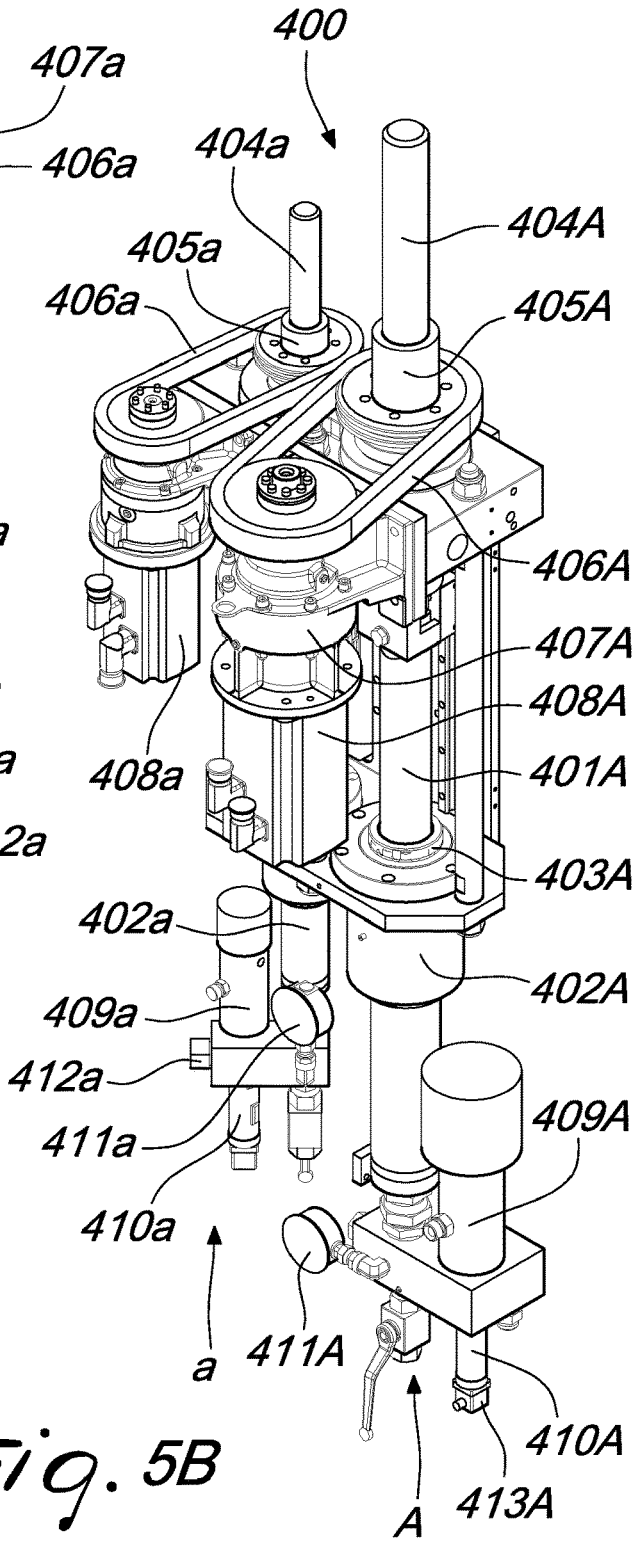

The base product dosage device comprises the following essential components [reference is made to the first dosage assembly (400)]: (401A) plunger or syringe; (402A) cylinder or chamber; (403A) hermetic seal; (404A) ballscrew; (405A) ballscrew sleeve; (406A) mechanical transmission, for example of the type with sprockets and chain; (407A) mechanical reduction unit; (408A) synchronous electric motor. It goes without saying that these components are coupled partly to an upper plate and partly to a lower plate which are connected by tension members, structural elements which are shared and used by the dosage device "A" of the base product and by the dosage device "a" of the catalyst product, as can be seen in FIGS. 5A and 5B.

The base product dosage device comprises the following auxiliary components, which are however in any case indispensable [reference is made again to the first dosage assembly (400)]: (409A) three-way valve, which can be replaced by two two-way valves or by a two-way valve and a one-way valve; (410A) pressure transducer; (411A) pressure gauge; (412A) overpressure valve or rupture disk; (413A) manual withdrawal valve (useful to check the stoichiometry of the dosage ratio by weighing quantities withdrawn simultaneously).

The catalyst product dosage device comprises the following essential components [reference is made to the first dosage assembly (400)]: (401*a*) plunger or syringe; (402*a*) cylinder or chamber; (403*a*) hermetic seal; (404*a*) ballscrew; (405*a*) ballscrew sleeve; (406*a*) mechanical transmission, for example of the type with sprockets and chain; (407*a*) mechanical reduction unit; (408*a*) synchronous electric motor.

Figure 6A:
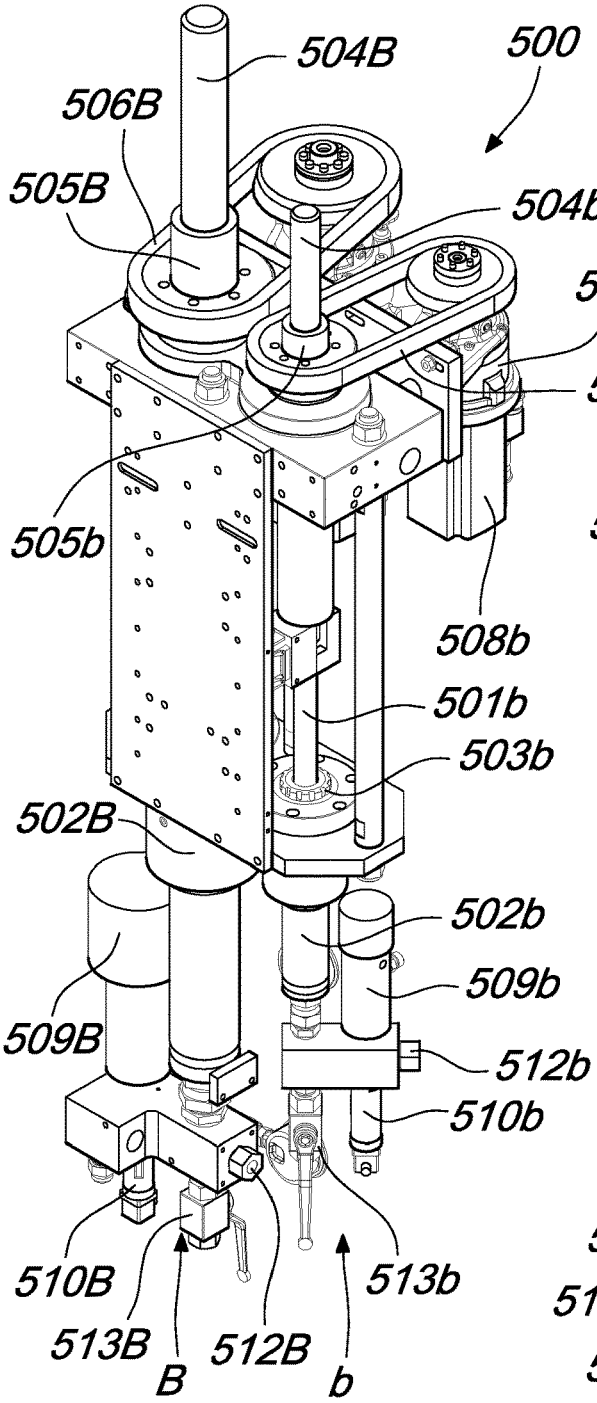
Figure 6B:
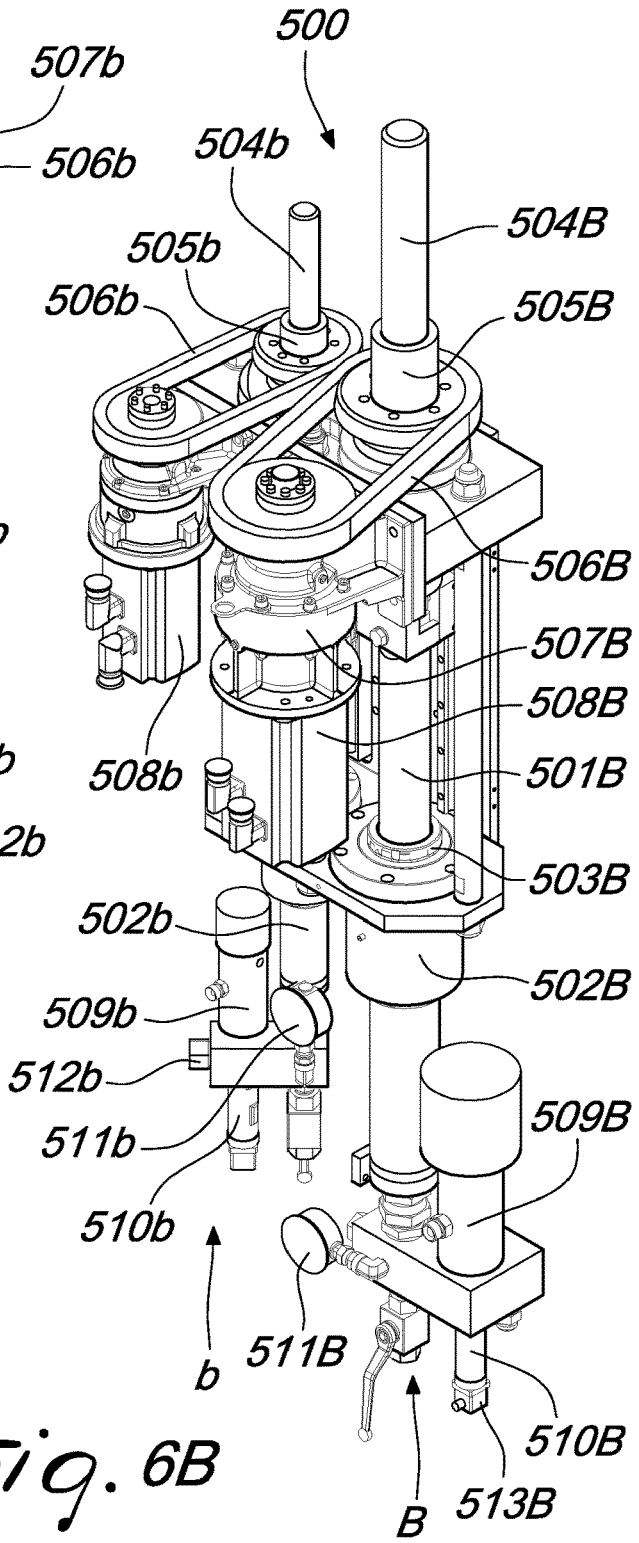

It goes without saying that these components are coupled partly to an upper plate and partly to a lower plate which are connected by tension members, structural elements which are shared and used by the dosage device "A" of the base product and by the dosage device "a" of the catalyst product, as can be seen in FIGS. 6A and 6B.

The catalyst product dosage device comprises the following auxiliary components, which are however in any case indispensable [reference is made again to the first dosage assembly (400)]: (409*a*) three-way valve, which can be replaced by two two-way valves or by a two-way valve and a one-way valve; (410*a*) pressure transducer; (411*a*) pressure gauge; (412*a*) overpressure valve or rupture disk; (413*a*) manual withdrawal valve (useful to check the stoichiometry of the dosage ratio by weighing quantities withdrawn simultaneously).

The corresponding description regarding the second dosage assembly (500) is superfluous, since it is possible to use the preceding description simply by replacing the first digit of the assembly "4" with "5" and the letters "A", "a" respectively with the letters "B", "b".

A particular characteristic of the present invention resides in using the communion of two dosage assemblies: the first dosage assembly (400) composed of the numberings "4_A" and "4_a" and the second dosage assembly (500) composed of the numberings "5_B" and "5_b" (the underscores referencing the variable digits that have already been used previously), all operating with the same sealant (typically PS or PU or SI), said communion being controlled by a swapping logic such as to maintain an active condition at the dosage nozzle (301) that is free from discontinuities, both in terms of flow-rate and in terms of pressure.

This is shown evidently in FIGS. 7 to 10 commented hereafter.

The swapping logic is obtained by acting in a complementary manner on the flow-rates of the first dosage assembly (400) (the uppercase letter "A" designates the base and the lowercase letter "a" designates the catalyst, the symbol "+" being used to indicate the sum of the base and of the catalyst) and of the second dosage assembly (500) (the uppercase letter "B" designates the base and the lowercase letter "b" designates the catalyst, the symbol "+" being used to indicate the sum of the base and of the catalyst) and in a controlled manner on the process pressures. In the case of a monocomponent sealant product, the lowercase "a" and lowercase "b" do not exist.

The single-line diagram of operation of the dosage assemblies is shown in FIG. 8, which shows the condition of the first dosage assembly (400) (A+a) in the step for dispensing toward the nozzle (301) which interacts with the peripheral region of the insulating glazing unit (1) and of the second dosage assembly (500) (B+b) during the reloading step; the shaded part of the symbols that represent the valves indicates the side in the closed state; the corresponding position in the chart or diagram of FIG. 7 being the one of the left part with (A+a) at the nominal flow-rate and with (B+b) at nil flow-rate.

It is straightforward to deduce the condition of the second dosage assembly (500) (B+b) in the step of dispensing toward the nozzle (301) which interacts with the peripheral region of the insulating glazing unit (1) and of the first dosage assembly (400) (A+a) in the reloading step, simply by reversing the state of the valves, with corresponding position in the diagram or chart of FIG. 7 of the right part with (A+a) at nil flow-rate and (B+b) at the nominal flow-rate.

In FIG. 8, the interrupted part on the left is assumed to be known, constituting respectively the feeding of the base product and of the catalyst product as arriving from the pumps, typically of the double-acting type, arranged on the pressing plates of the product storage drums for their transfer for feeding to the dosage devices, as already disclosed in the cited prior art.

Explanation must instead be given of the joint, complementary and simultaneous mode of dispensing of the first and second dosage assemblies (400, 500), i.e., the one related to the central position of the diagram or chart of FIG. 7, in which both the flows (A+a) and the flows (B+b) are active, this being a solution that is quite distant and highly innovative with respect to the situation of the closest background art of U.S. Pat. No. 8,480,940 B2 FIG. 2, which does not solve the problem of discontinuity during reversing transients, with consequent alteration of the dosage ratio and of the lack of aesthetic uniformity of the perimetric seal.

In general and with reference to the most widespread configuration of the insulating glazing unit (1), i.e., the rectangular one, the succession of the sides being sealed, in the case of a single-head sealing machine (300), is typically the following: first vertical side (1*a*), second horizontal upper side (1*b*), third vertical side (1*c*), fourth horizontal lower side (1*d*). The unavoidable transients of the flow of sealant at the corners where the nozzle (301) must rotate through 90° are already managed in the background art by reducing the relative speed between the nozzle (301) and the peripheral region of the insulating glazing unit (1) and the corresponding reduction of the flow-rate of sealant until said relative speed is canceled and the flow-rate is canceled in order to allow the rotation of the head (300) that supports the nozzle (301) and the closure of the valve (302).

The background art does not have a solution for the interruption of the flow of the sealant that derives from the depletion of the load of the dosage devices and is forced to perform a sudden transient, in reversing the effect of the double-acting dosage device, which has repercussions in the inaccuracy of the dosage ratio and in the aesthetics of the seal of the edge, said transient increasing in frequency as the cross-section of the joint increases, as the length of the side to be sealed increases and as the volumes of the dosage devices decreases.

Worse still, the volume of the dosage devices cannot exceed the typical value of (0.7÷0.8) liters (total: base "+" catalyst), since the compressibility of the sealants, although slight, entails an instability of the process in terms of nonlinearity of the equation [$v \times S = c1 \times S1 + c2 \times S2$]; where:

"v" is the nozzle (301)—insulating glazing unit (1) relative speed;

"S" is the area of the cross-section of the joint [which the process logic calculates as a product of the width of the spacer frame "w" by the "d" of its outer surface from the margin of the glass sheets, said distance being measured continuously by the probe (304) and transduced by the potentiometer (305)]

"c1" is the speed of the base syringe;

"S1" is the area of its cross-section;

"c2" is the speed of the catalyst syringe;

"S2" is the area of its cross-section.

This nonlinearity, which entails control difficulty, arises from the fact that upon the movement of the syringes, in a pressure variation condition, dispensing at the nozzle (301) is altered by the quantity removed or added for the volume variation of the sealant (7) caused by its compressibility. However, the present invention solves even this, by means of a solution described hereinafter.

With the mode of use of the first and second dosage assemblies (400, 500) and of their joint, complementary and simultaneous operation, as shown in FIG. 7, the dispensing of the sealant undergoes no discontinuities in the flow-rate or in the stoichiometry of the proportion of the base and catalyst components.

An important refinement, which is protected in a secondary claim, is to equalize the pressures of the second dosage assembly [(500) in the description discussed so far, which is taking over], which begins its extrusion ramp, toward the pressures of the dosage assembly [(400 in the description discussed so far, which is quitting], which begins its depletion ramp.

This is done by acting on the motors (508A) and (508*a*), which are provided with feedback by means of the transducers (510A) and (510*a*), prior to the actuation of the valves (509A) and (509*a*).

The transducers are arranged directly upstream of the valves (509A) and (509*a*), in the various versions of solutions for said valves, so that the pressure controls are not affected by the load losses of the circuits upstream thereof.

This is evident in FIGS. 8 and 10 by means of the symbol PIC (Controlled Indicated Pressure).

An additional refinement, which in any case is already background art, is to install the dosage assemblies on the carriage (200), as shown in FIGS. 2 and 4, so that the path of the product [(A+a) alternated with (B+b), in the case of a bicomponent sealant 7 or "A" alternated with "B" in the case of a monocomponent sealant 7] as shown in FIGS. 8 to 10 is the shortest possible, although the path itself includes the static mixer (303) which entails a load loss caused by the energy required for mixing.

As regards the logic and power controls used to embody the flow-rate diagram of FIG. 7 of the products (A+a) and (B+b), everything is summarized in FIG. 11, which indicates the main INPUTS and OUTPUTS at one of the controllers (306) and specifically:

Inputs:

#w=width of the spacer frame

#d=distance of its outer surface from the margin of the glass sheets

#v=relative speed between the peripheral region of the insulating glazing unit 1 and the extrusion nozzle 301

#signals from the pressure transducers

#feedbacks from the synchronous motors

Outputs:

#actuations toward the synchronous motors, such as to embody the equation [v×S=c1×S1+c2×S2], even in the steps of the ramps according to the central region of the diagram of FIG. 7.

Other parameters reside in the controllers, such as for example the cross-sections "S1" and "S2" of the syringes, since they are fixed data.

During these ramps, the first dosage assembly (400) reduces the speeds (c1) and (c2) of the syringes (401A) and (401*a*) from the nominal values, which correspond to the flow-rate (v×S) and to the stoichiometric dosage, until they are canceled, while the second dosage assembly (500) moves the syringes (501B) and (501*b*) from the inactive condition, i.e., with (c1) and (c2) equal to zero, up to the nominal values, which correspond to the flow-rate (v×S) and to the stoichiometric dosage.

The functions that control said ramps are such that the sum of the respective flow-rates (A+a+B+b) always corresponds to the nominal flow-rate (v×S). These functions can be linear or nonlinear.

This description refers to the more complete case of bicomponent sealant.

It goes without saying that it can be applied also to the case of a monocomponent sealant simply by eliminating the parts that describe the fluid of the catalyst.

The controllers (306) shown for the second dosage assembly (500) and the equivalent controller (306') for the first dosage assembly (400) communicate with the operator interface (307) located on board the control post (12).

The present invention is susceptible of numerous constructive variations (with respect to what can be deduced from the drawings, the details of which are evident and eloquent), all of which are within the scope of the appended claims; thus, for example, the mechanical solutions for the movements of the dosage syringes, the actuation means, which can be electrical, electrical-electronic, pneumatic, oil pressure-operated and/or combined, etc, the control means, which can be electronic or fluidic and/or combined, etc.

One variation of the known part of the invention, which however resides practically only in the software and therefore uses the same devices known for the sealing of rectangular insulating glazing units 1 described so far, is the one constituted by the logic combination of the synchronous actuations respectively: of horizontal translation along the axis H of the insulating glazing unit 1 by means of synchronous motors; of vertical translation along the axis V of the head (200) by means of a synchronous motor; of rotation about the axis θ of the head (300) by means of a synchronous motor; of actuation of the flow control element (302) of the nozzle (301) so as to allow sealing on an insulating glazing unit (1') that has a shape that is other than rectangular because it is a regular or irregular polygonal shape or on an insulating glazing unit (1") that has a shape that is other than rectangular because it is curvilinear or on an insulating glazing unit (1") that has a shape that is other than rectangular because it contains both rectilinear and curvilinear parts.

The constructive details can be replaced with other technically equivalent ones.

The materials and dimensions may be any according to the requirements in particular arising from the dimensions (base and height) and/or from the shape of the glass sheets (2, 2', 2", 2''', 2M, 2'*m*, 2"*m*) that will constitute the insulating glazing unit (1).

In particular, as shown in FIGS. 15 and 16, simply by virtue of a different distribution of the valves it is possible to use two or more dosage assemblies (400, 500, etc.), advantageously assigning each assembly to a specific sealing product, typically: polysulfide (PS), polyurethane (PU) and silicone (SI), so as to feed to the perimetric edge of the insulating glazing unit 1 the specific type of sealant (PS or PU or SI) that is required depending on the destination of the final product, the insulating glazing unit 1.

Therefore, for an equal device, i.e., the dosage device 999, it is possible to provide an important alternative use thereof simply by extending the connections of the device 999 not toward a single source of sealant X (as in U.S. Pat. No. 9,079,335 B2 and U.S. Pat. No. 8,480,940 B2, with source constituted by the base product 3 and by the catalyst product 4, for example the most frequently used polysulfide) but toward also at least a second source of sealant Y (for example polyurethane or silicone) and by simply adding a software subprogram to the software program of the controller of the machine 1000 while keeping unchanged all the components of the device 999.

Prior art documents U.S. Pat. No. 9,079,335 B2 and U.S. Pat. No. 8,480,940 B2 teach nothing regarding the possibility to feed the dosage devices with multiple types of sealant products simply by switching some valves; on the contrary, it is in fact necessary to replace the storage drums 3 and 4 (see the numbering in U.S. Pat. No. 9,079,335 B2) and purge the previous product from the circuits.

In this option, each dosage assembly works in the traditional manner according to the background art defined as of the first type in the chapter "BACKGROUND ART", but with the advantage of acquiring greater flexibility and greater automation in the uses of the automatic machine 1000.

In the background art, in fact, in order to use the machine 1000 with more than one sealant (designated in FIGS. 15 and 16 by the letters X, Y, etc.) it is necessary to replace the dosage assembly, an activity which, despite being controlled by systems such as guides and quick couplings, entail awkward manual intervention, procedure and devices to work safely and also requires production stops.

With the criterion of indicating closed valves in solid black and open valves in solid white, FIG. 15 shows the dosage assembly 400 in the exclusion condition and the dosage assembly 500 in the final step for filling the syringes with sealant Y (base "B"+catalyst "b") and therefore not yet in the dispensing step. Swapping (i.e., white to black and black to white in the illustration) the valves of the dosage assembly 500 would show the step of the beginning of the dispensing of the sealant Y (base "B"+catalyst "b") toward the nozzle 301.

With the same criterion, FIG. 16 shows the dosage assembly 500 in the exclusion condition and the dosage assembly 400 in the final step for dispensing the sealant X (base "A"+catalyst "a") toward the nozzle 301.

Swapping (i.e., white to black and black to white in the illustration) the valves of the dosage assembly 400 would show the step of the beginning of the filling of the syringes with sealant X (base "A"+catalyst "a").

It goes without saying that in the case of monocomponent sealant products the operating diagrams are the ones of FIGS. 15 and 16, in which the dosage devices related to the catalyst products (a, b) are inactive or do not exist and in which the mixer 303 is superfluous.

It goes without saying that the industrial application is assuredly successful, since machines for the automatic execution of the second seal of the insulating glazing unit 1 have developed particularly in the last decade, but these automatic sealing machines have limitations when the dimensions of the peripheral joint, in terms of area of its cross-section, and the extensions of the perimeter of the insulating glazing unit (1), in terms of length, are considerable and force waiting times to reload the dosage devices.

Today this type of insulating glazing units has undergone a surprising increase; it is sufficient to consider structural glazing, which extends over heights of more than one story, or commercial glazing, which reaches lengths of over 12 meters, and to consider that the large dimensions of the surface entail the use of equally important thicknesses of the glass sheets and consequently a substantial area of the joint in order to ensure the mechanical coupling between the glass sheets.

However, the assortment of automatic sealing machines according to the background art has turned out to be unsuitable for this parallel development of the final product or has solved the problem only partially.

Moreover, two important competitors have respectively developed and is engaged in the technology for forming the spacer frame (5) by direct extrusion against the face of the glass sheet, and both have not solved the requirements of high flow-rate and of continuity thereof apart from palliatives which are not satisfactory and are quite far from the solution described here.

The insertion of the present invention in the line for the production of the insulating glazing unit is shown in FIGS. 13 and 14 (overall view and plan view) as an evident confirmation of the assured success in industrial application, in view of the now established but constantly evolving diffusion of these lines.

The materials used, as well as the dimensions that constitute the individual components of the invention, may of course be more pertinent according to the specific requirements.

The characteristics indicated as advantageous, convenient or the like may also be omitted or be replaced with equivalents.

What is claimed is:

1. A dosage device for extruding a bicomponent or a monocomponent sealant, for an automatic machine for sealing a perimetric edge of an insulating glazing unit constituted by at least two glass sheets and by at least one spacer frame, having a finite width, which is arranged proximate to the perimeter at a finite distance from the margin of said glass sheets, comprising a first dosage assembly and a separate second dosage assembly for the dosage and feeding of said sealant, which can be activated alternatively, in a first feeding step and in a third feeding step, so that one of them provides flow continuity to an extrusion nozzle while the other one is in the reloading step, said first and second dosage assemblies being activatable, in a second swapping step that is intermediate with respect to said first and third feeding steps, simultaneously and jointly, one of them having a flow-rate ramp that passes from the steady-state value to zero and the other one complementarily having a flow-rate ramp that passes from zero to the steady-state value, wherein in said second swapping step, which is intermediate with respect to said first and third feeding steps, prior to the beginning of said flow-rate swapping ramps, each one of said first or second dosage assembly that is taking over aligns its own pressure with that of said dosage assembly that is quitting, by means of the actuations of synchronous electric motors which are provided with feedback through pressure transducers, and wherein the pressures of said second dosage assembly are equalized, in said second swapping step in which said flow-rate ramp passes from the steady-state value to zero, in said first dosage assembly, while at the same time said flow-rate ramp passes from the zero value to the steady-state value in said second dosage assembly, the equalization of said pressures occurring by means of said motors, which are provided with feedback by means of transducers, prior to the actuation of valves, said transducers being arranged directly upstream of said valves, the valves being configured to swap the first and second dosage assemblies, and wherein if a bicomponent sealant is used, each one of said first and second dosage assemblies doses and feeds a base product and a catalyst product, which, being each in a synchronous electric tie, is configured to dispense said base product and said catalyst product in the stoichiometric ration required by the manufacturer, and wherein if a monocomponent sealant is used, each one of said first and second dosage assemblies doses and feeds only one base product in synchronous electric tie, and wherein at least one controller is provided and configured to communicate with an operator interface, to activate the first dosage assembly and the second dosage assembly alternately, said dosage device further comprises a swapping logic and a power control configured to maintain an active condition at the extrusion nozzle, wherein the swapping logic is configured by acting in a complementary manner on a first flow-rate of the first dosage assembly and a second flow-rate of the second dosage assembly, and the power control includes the at least one controller configured to communicate with the first dosage assembly and the second dosage assembly.

2. The dosage device according to claim 1, wherein each dosage device has a volume that does not exceed a value of 0.8 liters.

* * * * *